US007828282B2

(12) United States Patent
Zhang

(10) Patent No.: US 7,828,282 B2
(45) Date of Patent: Nov. 9, 2010

(54) PICK-ARM MEMBER TO DETECT MEDIA AMOUNT

(75) Inventor: Hongsheng Zhang, San Diego, CA (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 12/178,849

(22) Filed: Jul. 24, 2008

(65) Prior Publication Data

US 2010/0019441 A1 Jan. 28, 2010

(51) Int. Cl.
*B65H 7/08* (2006.01)

(52) U.S. Cl. ..... 271/110; 271/117

(58) Field of Classification Search ..... 271/110, 271/117, 118

See application file for complete search history.

(56) References Cited

U.S. PATENT DOCUMENTS 5,029,837 A * 7/1991 Uchiyama ..... 271/110
5,839,015 A * 11/1998 Faguy et al. ..... 399/23
5,842,694 A * 12/1998 Brooks et al. ..... 271/38
6,000,871 A 12/1999 Fisher, Sr.
6,237,909 B1 * 5/2001 Carter et al. ..... 271/110
6,494,076 B1 * 12/2002 Gent et al. ..... 73/9
7,374,163 B2 * 5/2008 Cook et al. ..... 271/145
2002/0084574 A1 7/2002 Kim
2003/0209657 A1 11/2003 Vejtasa
2006/0087070 A1 4/2006 Cook et al.
2007/0246880 A1 10/2007 Totsuka et al.

OTHER PUBLICATIONS

U.S. Appl. No. 12/178,713, filed Jul. 24, 2008, Zhang.

* cited by examiner

*Primary Examiner*—David H Bollinger
(74) *Attorney, Agent, or Firm*—Stephen H. Shaw; Eugene I. Shkurko

(57) ABSTRACT

An imaging system includes a media holder configured to hold a plurality of sheets of media. A pick arm, including a pick roller, is positioned to contact an individual sheet of the plurality of sheets of media in the media holder. A member has a measurable property that is sensed by a sensor in correlation with a position of the individual sheet of the media in the media holder. The member or the sensor is movable by the pick arm along a path such that the measurable property is sensed by the sensor in order to provide a signal indicative of the position of the individual sheet of media in the media holder. The member produces zero drag upon the individual sheet of media.

8 Claims, 15 Drawing Sheets

PICK-ARM MEMBER TO DETECT MEDIA AMOUNT

FIELD OF THE INVENTION

The present invention relates generally to the detection of the amount of paper or other media in a stack, and more particularly to the detection of the amount of media in an input tray of a printer or other imaging system.

BACKGROUND OF THE INVENTION

In a printer, a copier or other imaging system, paper or other media is loaded as a stack of cut sheets. For example, blank paper or other recording media is loaded into one or more input trays so that it can be printed. How much media is left in the input tray is not always readily apparent to the user because of the design and location of the input tray. Yet the information of how much media remains is useful for managing the printing operation, as well as for an early warning that more media will be needed to be supplied. As a first example, suppose a user requests a print job requiring 20 sheets of media, but only 10 sheets are in the input tray. If the user leaves the printing job unattended and comes back later, he will be disappointed to find that the printing job is unfinished because the printer ran out of paper. In addition, while waiting for the job to continue, the printhead may return to the maintenance station and expel additional ink that would not have occurred otherwise. As a second example, if a user has a job that needs to be printed, but does not realize he is almost out of paper, he may need to make a special trip to get more, thus causing delays in printing the job. In this example, an early warning would be helpful so that the user can get more paper before his local supply runs out.

Media stack height detectors have been disclosed in the prior art, for example U.S. Pat. Nos. 5,839,015 and 7,374,163. However, competitive pressures make it desirable to incorporate the function of media stack height detection at low cost. Prior art media stack height detectors typically use an extra coupling component that contacts the top sheet of the media stack at one end and has a portion that provides a stack-height-dependent signal to a corresponding sensor at another other end. The extra coupling component not only adds cost to the system, but also its contacting the sheet of media adds drag as the sheet is being moved from the media input tray into a position for printing. Thus an improved apparatus and method for detecting media stack height is needed.

SUMMARY OF THE INVENTION

The aforementioned need is met by an imaging system that includes a media holder configured to hold a plurality of sheets of media. A pick arm, including a pick roller, is positioned to contact an individual sheet of media in the media holder. A member has a measurable property that is sensed by a sensor in correlation with a position of the individual sheet of media in the media holder. The member or the sensor is movable by the pick arm along a path such that the measurable property when sensed by the sensor provides a signal indicative of the position of the individual sheet of media in the media holder. The member produces zero drag upon the individual sheet of media.

Another embodiment provides a printing system that includes:

a tray configured to hold a plurality of sheets of recording media;

a pick arm including a pick roller, the pick roller configured to contact an individual sheet of the plurality of sheets of media in the tray;

a light emitter;

an optical sensor spaced apart from the light emitter; and a member that is movable by the pick arm in order to provide a signal indicative of a position of the individual sheet of the plurality of sheets of media in the tray.

Another aspect of the present invention provides a method for detecting a position of an individual sheet of media within a media holder, including the following steps:

positioning a pick arm having a pick roller to contact the individual sheet of media in the media holder;

sensing, with a sensor, a measurable property correlating to a member; and providing a signal indicative of the position of the individual sheet of media in the media holder to a controller.

DETAILED DESCRIPTION OF THE INVENTION

Although the examples described herein refer to inkjet carriage printer systems, other types of printing systems can also benefit from the advantages of low-cost media stack height detection as provided by this invention. Such printing systems can include a variety of inkjet printing systems, other types of printing or copying technologies such as dye sublimation systems or electrophotographic systems, or in general, monitoring the height of a stack of media even if the intended usage of the media is not for printing on.

Figure 1:
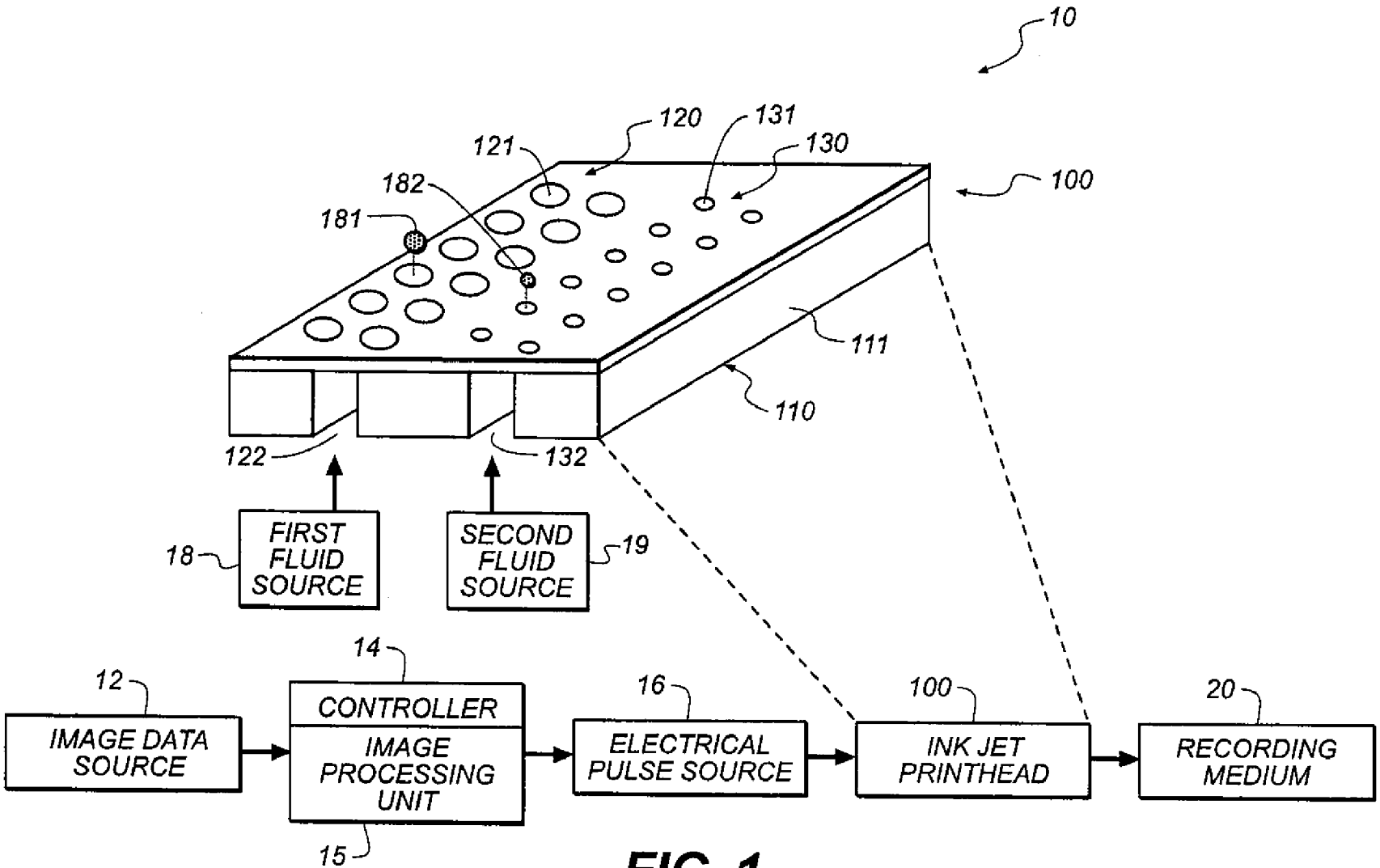
FIG. 1 is a schematic representation of an inkjet printer system.

Referring to FIG. 1, a schematic representation of an inkjet printer system 10 is shown, as described in U.S. Pat. No. 7,350,902, and incorporated by reference herein in its entirety. Printer system 10 includes a source 12 of image data, which provides data signals that are interpreted by a controller 14 as being commands to eject drops. Controller 14 includes an image processing unit 15 for rendering images for printing, and outputs signals to a source 16 of electrical energy pulses that are inputted to an inkjet printhead 100, which includes at least one printhead die 110. In the example shown in FIG. 1, there are two nozzle arrays 120, 130 for inkjet printhead 100. Nozzles 121 in the first nozzle array 120 have a larger opening area than nozzles 131 in the second nozzle array 130. In this example, each of the two nozzle arrays 120, 130 has two staggered rows of nozzles, each row having a nozzle density of 600 per inch. The effective nozzle density then in each array 120, 130 is 1200 per inch. If pixels on the recording medium were sequentially numbered along the paper advance direction, the nozzles from one row of an array would print the odd numbered pixels, while the nozzles from the other row of the array would print the even numbered pixels. In fluid communication with each nozzle array is a corresponding ink delivery pathway. Ink delivery pathway 122 is in fluid communication with nozzle array 120, and ink delivery pathway 132 is in fluid communication with nozzle array 130. Portions of fluid delivery pathways 122 and 132 are shown in FIG. 1, as openings through printhead die substrate 111. One or more printhead die 110 can be included in inkjet printhead 100, but only one printhead die 110 is exemplarily shown in FIG. 1 for simplistic illustrative purposes. The printhead die is arranged on a support member as discussed below relative to FIG. 2. In FIG. 1, a first ink source 18 supplies ink to first nozzle array 120 via ink delivery pathway 122, and a second ink source 19 supplies ink to second nozzle array 130 via ink delivery pathway 132. Although distinct ink sources 18 and 19 are shown, in some applications it may be beneficial to have a single ink source supplying ink to both nozzle arrays 120 and 130 via ink delivery pathways 122 and 132 respectively. Also, in some embodiments, fewer than two nozzle arrays are included on printhead die 110 in other embodiments more than two nozzle arrays are used. In some embodiments, all nozzles on a printhead die 110 may be the same size, rather than having multiple sized nozzles on a printhead die.

Not shown in FIG. 1, are the drop forming mechanisms associated with the nozzles. Drop forming mechanisms can be of a variety of types, some of which include a heating element to vaporize a portion of ink and thereby cause ejection of a droplet, or a piezoelectric transducer to constrict the volume of a fluid chamber and thereby cause ejection, or an actuator which is made to move (for example, by heating a bi-layer element) and thereby cause ejection. In any case, electrical pulses from pulse source 16 are sent to the various drop ejectors according to the desired deposition pattern. In the example of FIG. 1, droplets 181 ejected from nozzle array 120 are larger than droplets 182 ejected from nozzle array 130, due to the larger nozzle opening area. Typically other aspects of the drop forming mechanisms (not shown) associated respectively with nozzle arrays 120 and 130 are also sized differently in order to optimize the drop ejection process for the different sized drops. During operation, droplets of ink are deposited on a recording media 20.

Figure 2:
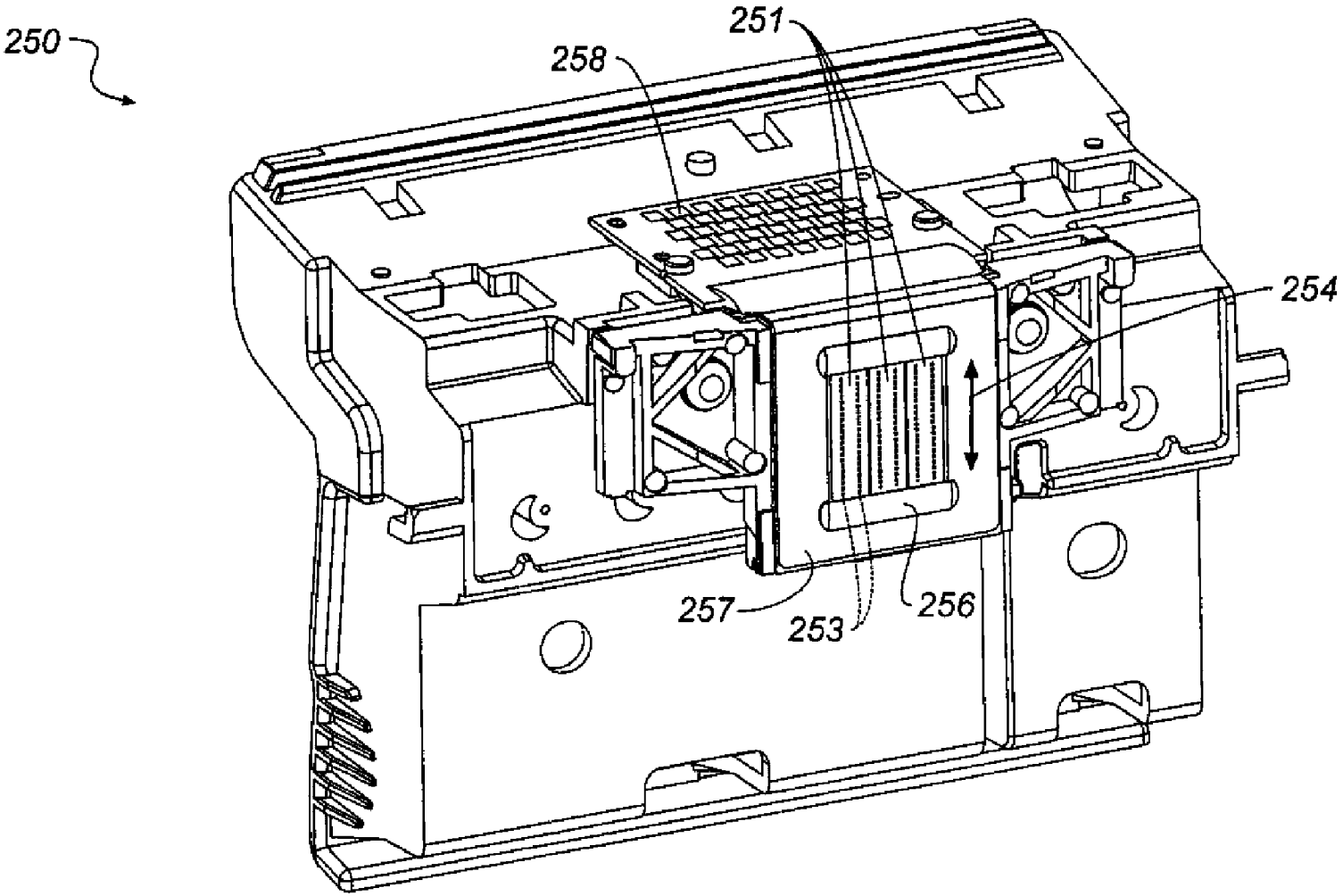
FIG. 2 is a perspective view of a portion of a printhead chassis.

FIG. 2 shows a perspective view of a portion of a printhead chassis 250, which is an example of an inkjet printhead 100. Printhead chassis 250 includes three printhead die 251 (similar to printhead die 110), each printhead die containing two nozzle arrays 253, so that printhead chassis 250 contains six nozzle arrays 253 altogether. The six nozzle arrays 253 in this example may be each connected to separate ink sources (not shown in FIG. 2), such as cyan, magenta, yellow, text black, photo black, and a colorless protective printing fluid. Each of the six nozzle arrays 253 is disposed along direction 254, and the length of each nozzle array along direction 254 is typically on the order of 1 inch or less. Typical lengths of recording media are 6 inches for photographic prints (4 inches by 6 inches), or 11 inches for 8.5 by 11 inch paper. Thus, in order to print the full image, a number of swaths are successively printed while moving printhead chassis 250 across the recording media. Following the printing of a swath, the recording media is advanced.

Also shown in FIG. 2 is a flex circuit 257 to which the printhead die 251 are electrically interconnected, for example by wire bonding or TAB bonding. The interconnections are covered by an encapsulant 256 to protect them. Flex circuit 257 bends around the side of printhead chassis 250 and connects to connector board 258. When printhead chassis 250 is mounted into the carriage 200 (see FIG. 3), connector board 258 is electrically connected to a connector (not shown) on the carriage 200, so that electrical signals may be transmitted to the printhead die 251.

Figure 3:
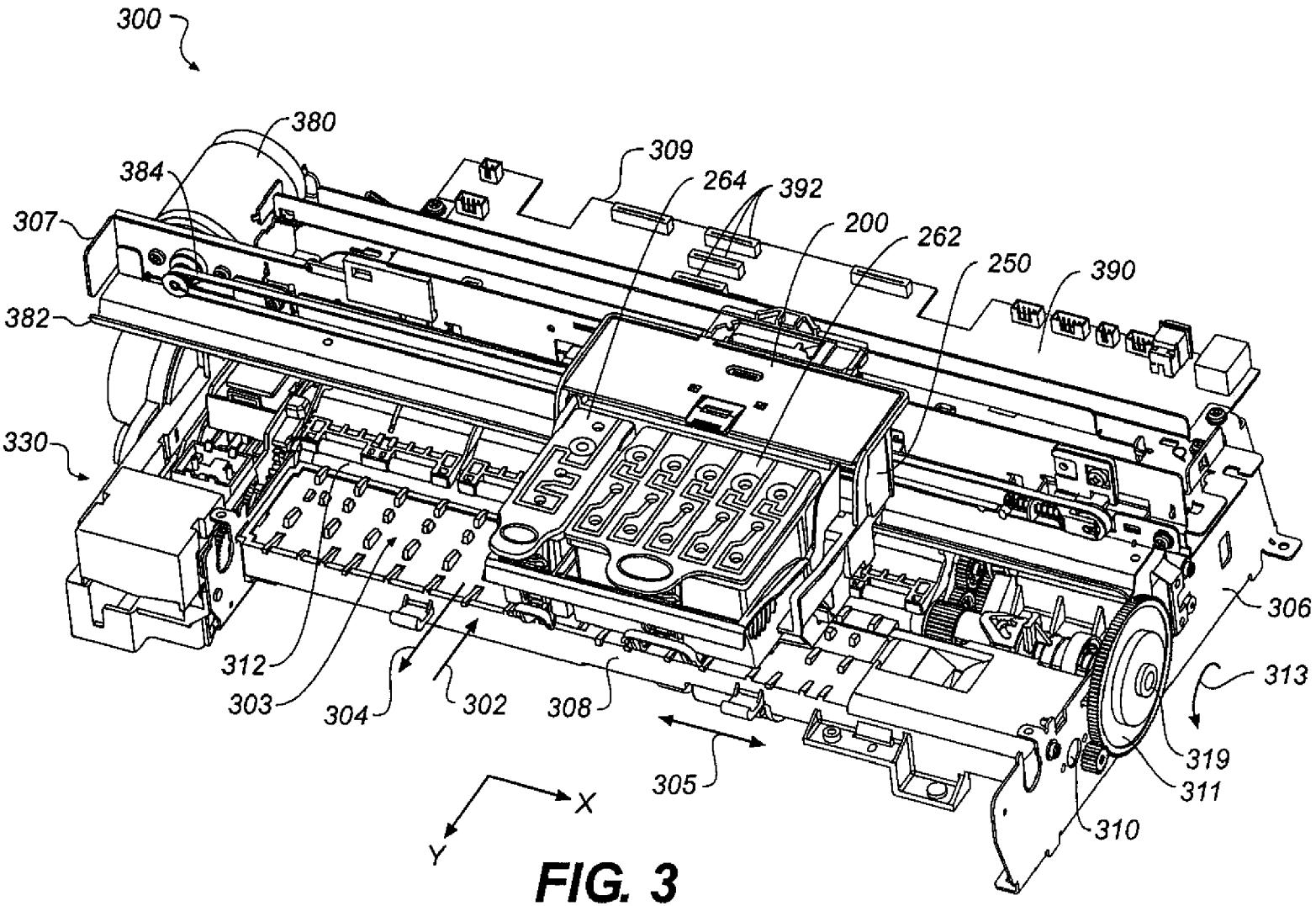
FIG. 3 is a perspective view of a portion of a carriage printer.

FIG. 3 shows a portion of a carriage printer. Some of the parts of the printer have been hidden in the view shown in FIG. 3 so that other parts may be more clearly seen. Printer chassis 300 has a print region 303 across which carriage 200 is moved back and forth in direction 305 along the X axis, between the right side 306 and the left side 307 of printer chassis 300, while drops are ejected from printhead die 251 on printhead chassis 250 that is mounted on carriage 250. Carriage motor 380 moves belt 384 to move carriage 200 along carriage guide rail 382. Printhead chassis 250 is mounted in carriage 200, and ink supplies 262 and 264 are mounted in the printhead chassis 250. The mounting orientation of printhead chassis 250 is rotated relative to the view in FIG. 2, so that the printhead die 251 (shown in FIG. 2) are located at the bottom side of printhead chassis 250, the droplets of ink being ejected downward onto the recording media in print region 303 in the view of FIG. 3. Ink supply 262, in this example, contains five ink sources cyan, magenta, yellow, photo black, and colorless protective fluid, while ink supply 264 contains the ink source for text black. Paper or other recording media (sometimes generically referred to as paper herein) is loaded, in this example, along paper load entry direction 302 at the front portion 308 of printer chassis 300. A variety of rollers are used to advance the recording media through the printer, as shown schematically in the side view of FIG. 4. In this example, a pickup roller 320 moves the top sheet 371 of a stack 370 of paper or other recording media in the direction of arrow 302. A turn roller 322, toward the rear portion 309 of the printer chassis 300 shown in FIG. 3, acts to move the paper around a C-shaped path (in cooperation with a curved rear wall surface) so that the paper continues to advance along direction arrow 304 from the rear direction 309 of the printer shown in FIG. 3. The paper is then moved by feed roller 312 and idler roller(s) 323 to advance along the Y axis 9 in FIG. 3 and across print region 303, and from there to a discharge roller 324 and star wheel(s) 325 so that a paper, printed with an image, exits along direction 304. Feed roller 312 includes a feed roller shaft 319 along its axis, and feed roller gear 311 is mounted on the feed roller shaft 319. Feed roller 312 can include of a separate roller mounted on feed roller shaft 319, or a thin high friction coating on feed roller shaft 319. The motor that powers the paper advance rollers is not shown in FIG. 1, but the hole 310 at the right side 306 of the printer chassis 300 (shown in FIG. 3) is where the motor gear (not shown) protrudes through in order to engage feed roller gear 311, as well as the gear for the discharge roller (not shown). For normal paper pick-up and feeding, it is desired that all rollers rotate in forward direction 313. Toward the left side 307 in the example chassis 300 shown in FIG. 3 is the maintenance station 330. Toward the rear portion 309 of the printer in chassis 300 is located electronics board 390, which includes cable connectors 392 for communicating via cables (not shown) to the printhead carriage 200 and from there to the printhead chassis 250. Also mounted on the electronics board 390 are motor controllers for the carriage motor 380 and for the paper advance motor, a processor and/or other control electronics (shown schematically as 14 and 15 in FIG. 1) for controlling the printing process, including image processing, and an optional connector for a cable to a host computer.

Figure 5:
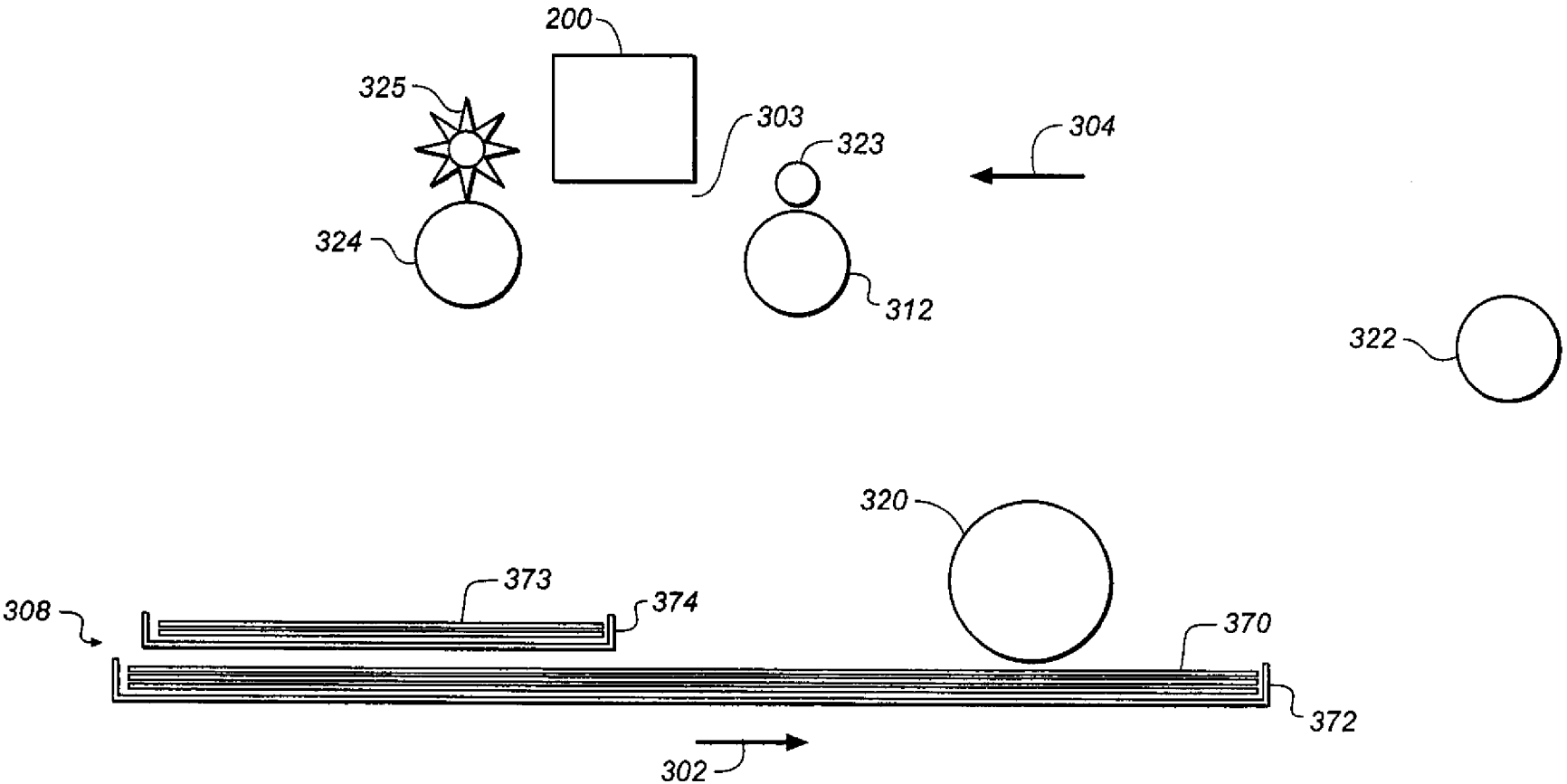
FIG. 5 is a schematic side view of a paper path in a carriage printer, including a main media tray, and a photo media tray located in a standby position.
Figure 6:
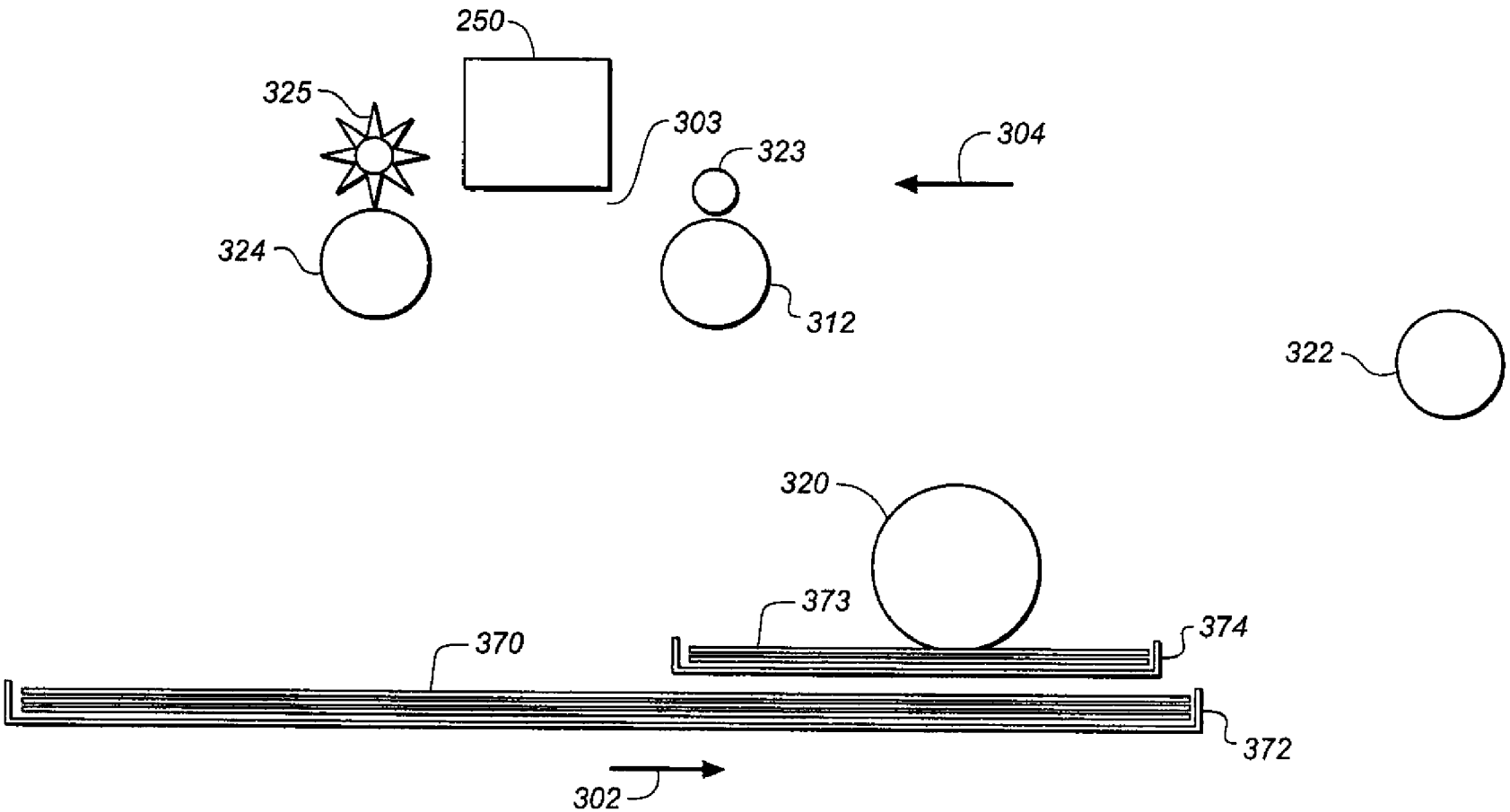
FIG. 6 is a schematic side view of a paper path in a carriage printer, including a main media tray, and a photo media tray located in a printing position.

In some carriage printers there is both a main media tray for a standard sized sheet of paper, as well as a smaller media tray for holding photo media, as shown, for example, in FIGS. 5 and 6. In both figures there is a paper stack 370 in main paper tray 372 and there is a stack of photo media 373 in photo media tray 374. In this example, the main paper tray 372 is able to hold sheets of media up to a highest stack level. The bottom of photo media tray 374 is configured to be spaced apart from the top sheet of media in the main paper tray 372 when the main paper tray 372 is full, so that that photo paper tray 374 can move freely, even when the main paper tray 372 is full. The sheets in paper stack 370 are of a larger size (for example, 8.5"×11") compared to the sheets in paper stack 373 (for example, 4"×6"), and photo media tray 374 is not as long as main paper tray 372. In the example shown schematically in FIG. 5, the photo media tray 374 is in a standby position near the front portion 308 of the printer. With the photo media tray 374 in this position, a pick roller 320 is able to contact the top sheet in paper stack 370 in the main tray 372. Also in the standby position of the photo media tray 374, additional photo media 373 can be loaded, while photo media tray 374 is in standby position near the front portion 308 of the printer. In FIG. 6, the photo tray 374 has been moved along direction 302 to its printing position. When the photo media tray 374 is in the printing position, the pickup roller 320 is able to contact the top sheet in photo media stack 373. A first signal can be sent to the printer controller when the photo media tray 374 is in the standby position so that the printer controller knows that the pickup roller 320 is in contact with media in the main paper tray 372. A second signal can be sent to the printer controller when the photo media tray 374 is in the printing position so that the printer controller knows that the pickup roller 320 is in contact with media in the photo paper tray 374.

Figure 7:
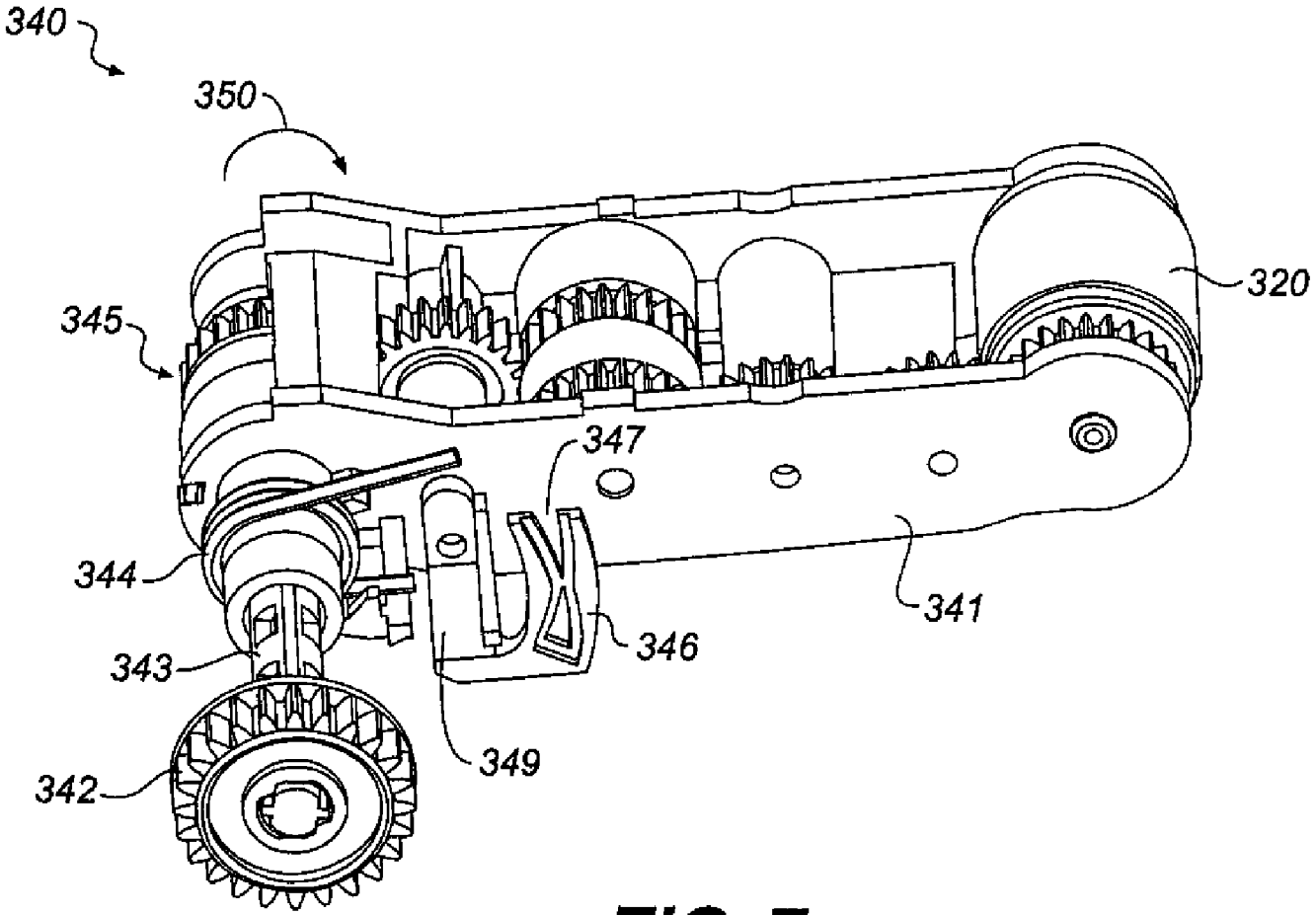
FIG. 7 is a perspective view of a pick arm assembly embodying aspects of the present invention.

In some embodiments, the pickup roller 320 is mounted on a pivotable pick arm, which is able to be moved up or down to rest on the top sheet of media, whichever media tray is beneath it. FIG. 7 shows a pivotable pick arm assembly 340. In the embodiment show, pick roller 320 is rotationally mounted near an end of pick arm frame 341. Near the other end of pick arm frame 341, drive gear 342 is mounted on axle 343, whose axis is coincident with the pivot axis of pick arm assembly 340. Drive gear 342 receives power from the paper advance motor (not shown), and transmits the power through axle 343 and gear train 345 to pick roller 320. Optionally, a torsion spring 344 provides a torque to cause the pick arm assembly 340 to rotate about its pivot axis in direction 350, so that the surface of the pick roller 320 is forced into contact with the top sheet of media.

A novel aspect of the pivotable pick arm assembly 340 shown in FIG. 7 is the attached optical block 346 including at least one window 347. The optical block 346 and its associated window are mounted onto and spaced apart from pick arm frame 341 by bracket 349. Optionally, bracket 349 may be formed integrally with optical block 346 and its window, for example by injection molding. As pick arm assembly 340 rotates about its pivot axis until the pick roller 320 is positioned to contact an individual sheet in a paper stack 370, for example, the top sheet in main paper tray 372 or the top sheet in photo media tray 374 (depending on whether photo media tray 374 is in its standby position or its printing position respectively), optical block 346 and its associated window will pivot together with the pick arm assembly 340. Thus as pick roller 320 is raised or lowered to contact the top sheet of media, optical block 346 and its associated window are also raised or lowered. In other words optical block 346 is a member that is movable by pick arm assembly 340.

Figure 8:
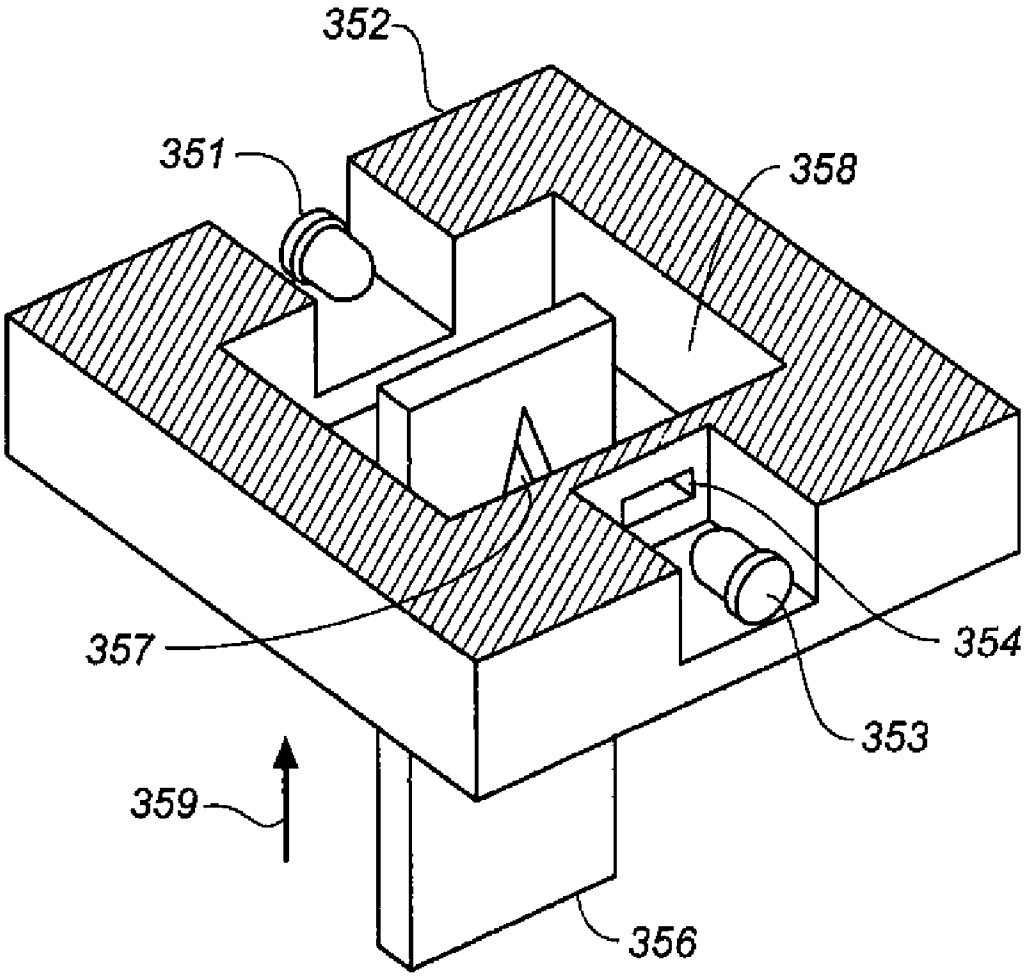
FIG. 8 is a cutaway view of a sensor housing surrounding an optical block having a window with a varying width.

The position of the optical block 346, and therefore the position of the pick roller 320 and the corresponding position of the individual sheet of media contacted by pick roller 320, may be detected by the amount of light received by an optical sensor 351, as illustrated schematically in the cutaway view of FIG. 8. Optical sensor 351, in this example, is a photosensor that is mounted in sensor housing 352, which also houses light emitter 353 (typically an LED). Sensor housing 352 is stationarily mounted on printer chassis 300, and is configured to have an open region 358 in the optical path between optical sensor 351 and light emitter 353, so that optical sensor 351 is spaced apart from light emitter 353. Optical block 356 and associated window 357 move up and down along direction 359 within open region 358. (Direction 359 is shown as a straight line in FIG. 8, but it can also be an arc, as shown by pivoting direction 350 with regard to pivoting optical block 346 of FIG. 7.) Window 357 allows a different amount of light from light emitter 353 by optical sensor 351, depending upon the position of optical block 356. In the example of FIG. 8, this is because window 357 consists of a tapered opening in optical block 356. In other words, the width of window opening 357 varies, with the variation being substantially along the length of the optical block which is along direction 359.

Although sensor housing 352 has been cut away in FIG. 8, in order to show optical sensor 351 and light emitter 353, in actuality optical sensor 351 is shielded so that it predominantly can receive light only from light emitter 353. In addition, a slit aperture 354 can be positioned to be between light emitter 353 and optical block 356 in order to increase the resolution and minimize signal noise from optical sensor 351 corresponding to the position of optical block 356 and associated tapered opening 357. Slit aperture 354 has a narrow dimension W that is substantially parallel to direction 359, and a longer dimension L that is substantially perpendicular to direction 359. The narrow dimension W of slit aperture 354 is typically within a range of 0.1 mm to 3.0 mm. The longer dimension L is typically roughly parallel with the plane of the top sheet of paper (i.e., roughly parallel to the bottom of the media tray in the case where the media holder is a tray). However, in order to provide the best signal for the case where the optical block moves in a pivoting arc, it can be advantageous for the long dimension L of slit aperture 354 to be slightly non-parallel to the bottom of the media tray.

Figure 9:
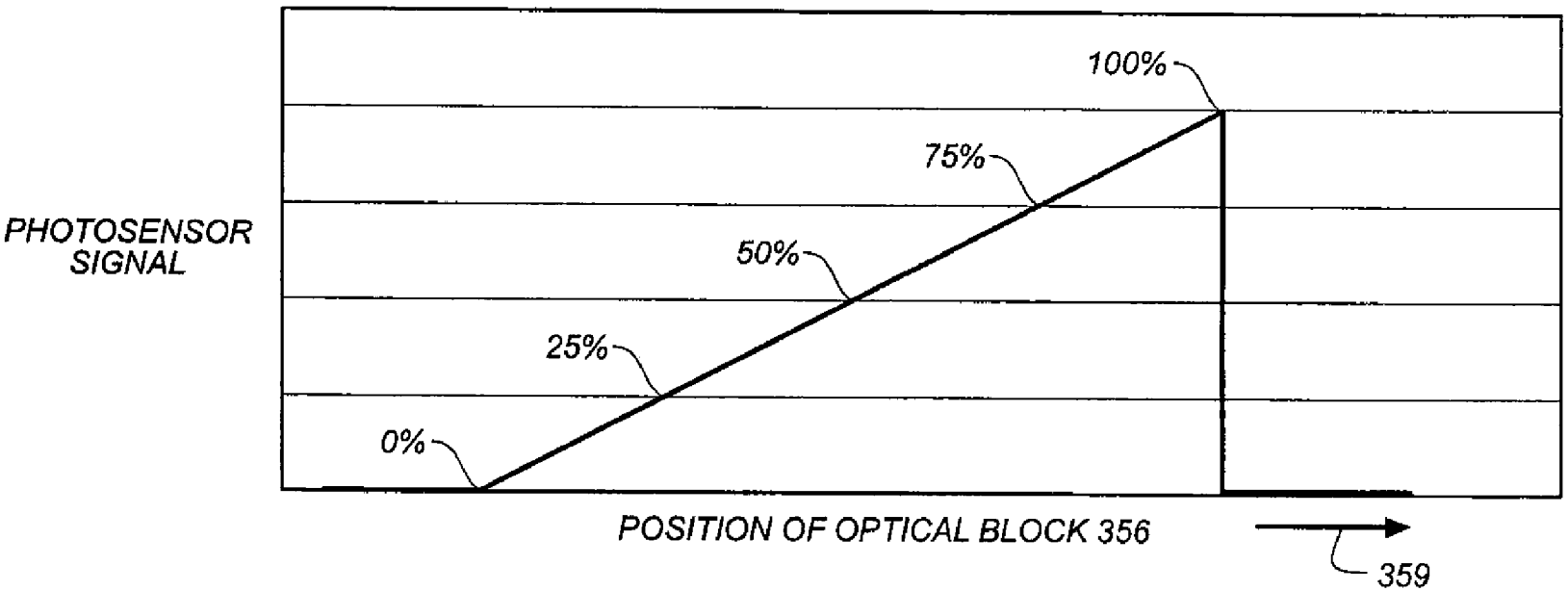
FIG. 9 is a representation of the variation in the photosensor signal as a function of the position of the optical block for the case of a window width that varies linearly.

The signal from optical sensor 351 is sent to the printer controller electronics. The photosensor signal increases as more light is received by optical sensor 351. In the schematic shown in FIG. 8, as optical block 356 moves upward (corresponding to a higher position of the pick roller 320 in FIG. 7, i.e., a higher media stack height), less light is blocked by tapered window opening 357 and the photosensor signal increases accordingly. This is shown schematically in FIG. 9 for the case of a window 357 where the tapering is linear, i.e. in this example the width of the window 357 varies linearly along optical block 356. The pick roller height, and therefore the height of the top sheet of media in the tray can thus be monitored via the photosensor signal. For example, if the photosensor signal is at the levels indicated as 25%, it indicates that the media stack height is 25% of its maximum (i.e., 25% of the recording media is left). Of course, the percentages shown in FIG. 9 are just examples. The photosensor signal varies in a continuous fashion so that stack height levels anywhere between 0% and 100% may be indicated. Optionally, the photosensor signal may be calibrated by measuring the signal at the 100% point (just before the drop-off) and adjusting the energy provided to the light source until the photosensor signal reaches the proper magnitude.

Figure 10:
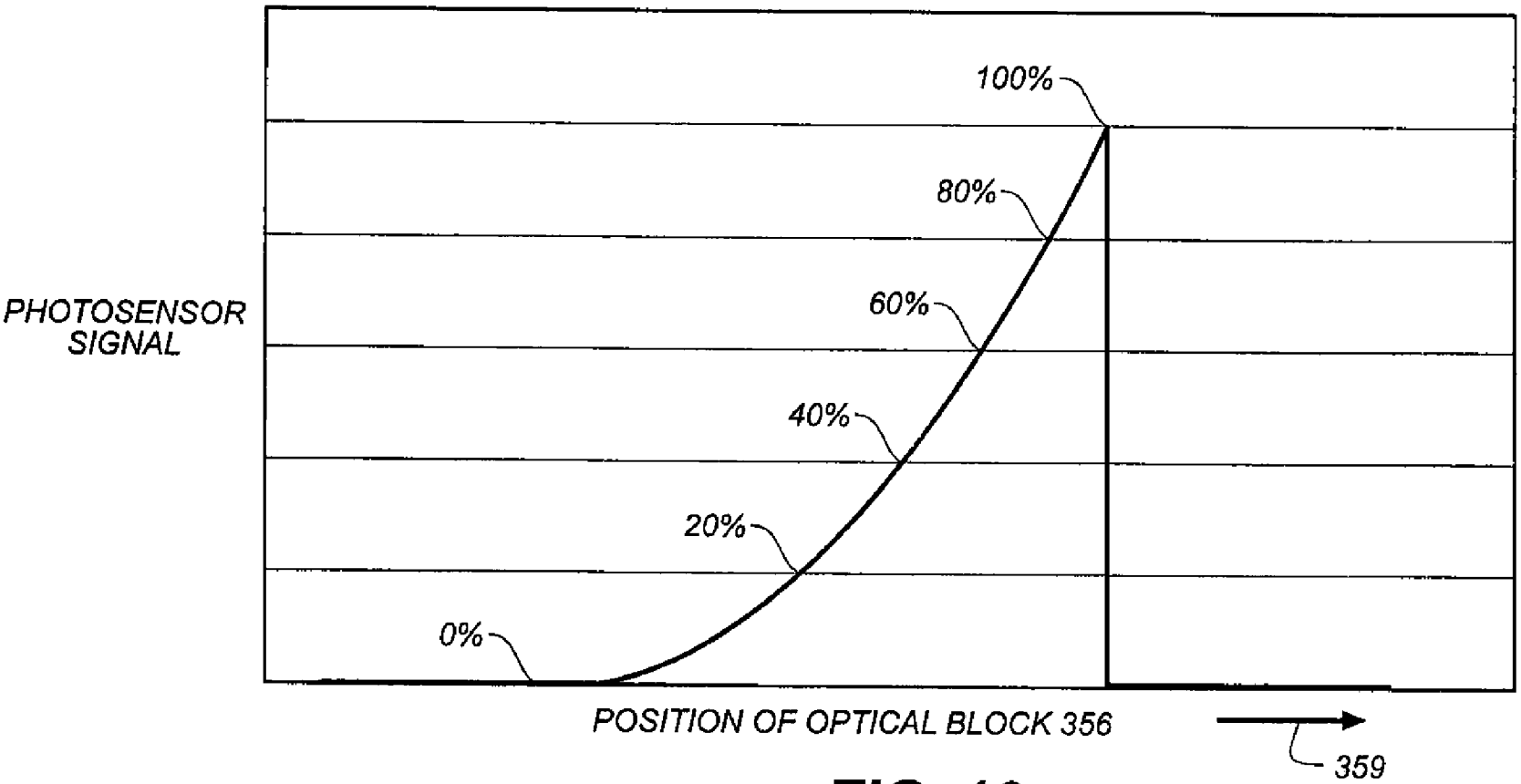
FIG. 10 is a representation of the variation in the photosensor signal as a function of the position of the optical block for the case of a window width that varies quadratically.

In the example described above, the variation of the width of optical window 357 is linear along optical block 356, so that the optical window is shaped somewhat like a triangle. However, for greater sensitivity (i.e., greater change in photosensor signal as a function of media stack height) the window opening shape can vary faster than linearly along optical block 356. FIG. 10 illustrates the photosensor signal for a window opening having a shape somewhat like a parabola (i.e. the width of the window varies quadratically along the length of the optical block). In other embodiments the window width can vary with other curvatures than quadratic, but in an exemplary embodiment the variation is faster than linear. In addition to optional curvature due to the rate of variation of the width of the window opening, the window may also have a curvature such that a line drawn along the center points of the window is arc-shaped, where the arc has a radius of curvature that is substantially equal to the distance from the arc to the pivot axis of the pick arm assembly 340. In this way, the rotation of the window as the pick arm assembly 340 pivots is compensated for.

Prior art media stack height detectors have employed an optical block, or other physically varying member, that is coupled to the top sheet of media separately than through the pick arm assembly. This incurs extra parts, extra cost, and extra drag on the media during media advance. In addition, the coupling member in the prior art must be separately raised in order to load paper, which presents an inconvenience to the user. For printers having a pick arm assembly 340 where the pick roller 320 is caused to rest on the top sheet of media so that it can move the top sheet of media, the configuration of having the optical block mounted to the pick arm assembly, as disclosed here, is thus advantageous over prior art media stack height detectors where the optical block is separately coupled to the top sheet of media.

Note that while in the example described above, the optical block moves with the pick arm assembly 340 and the sensor housing is kept stationary, other alternatives include mounting the sensor housing on the pick arm assembly 340 and keeping the optical block stationary.

The embodiments described above in which the window is an opening in the optical block are particularly advantageous. First of all, such a configuration is easy to mold by injection molding. Secondly, the window openings do not provide a surface for ink mist, dust or other contaminants to land on. Therefore such window openings do not change appreciably over the life of the printer. In an alternative embodiment, the optical block has an opaque section and a transparent window section.

Figure 11A:
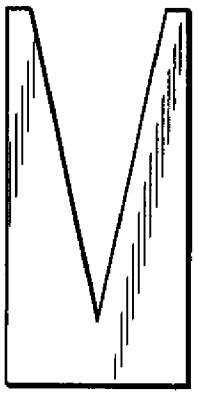
FIGS. 11A through 11E are schematic representations of several configurations of optical blocks.
Figure 11B:
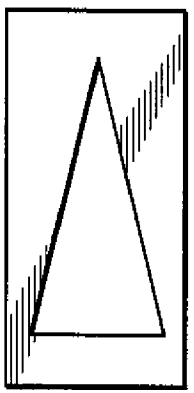
Figure 11C:
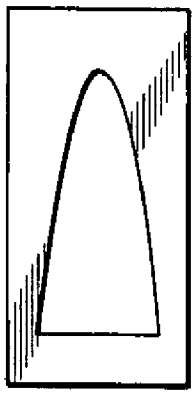
Figure 11D:
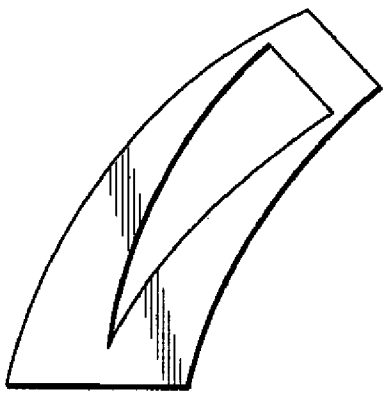
Figure 11E:
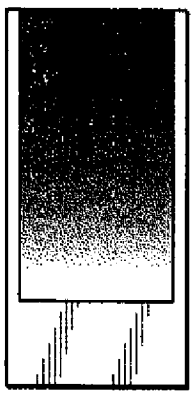

FIGS. 11A through 11E are schematic representations of optical blocks of various configurations. In FIG. 11A the change in window width is linear along the length of the optical block, so that the window is triangular. In FIG. 11B, the sense of taper is opposite that in FIG. 11A. FIG. 11C shows a window having a curvature that is faster than linear. In this particular example, the curvature is quadratic, so that the window is parabolic. In FIG. 11D, the optical block is curved with a radius of curvature substantially equal to the distance from the pivot axis to the center of the window. In the example of FIG. 11D, the window width varies faster than linearly along an arc defined by the center of the optical block. FIG. 11E is an example where the window is not an opening, but rather is a member having an optical transmission that varies along the length of the optical block. In the window of FIG. 11E, there is a gradient in optical transmission that varies from substantially optically transparent to more cloudy and translucent, or even opaque.

Figure 12:
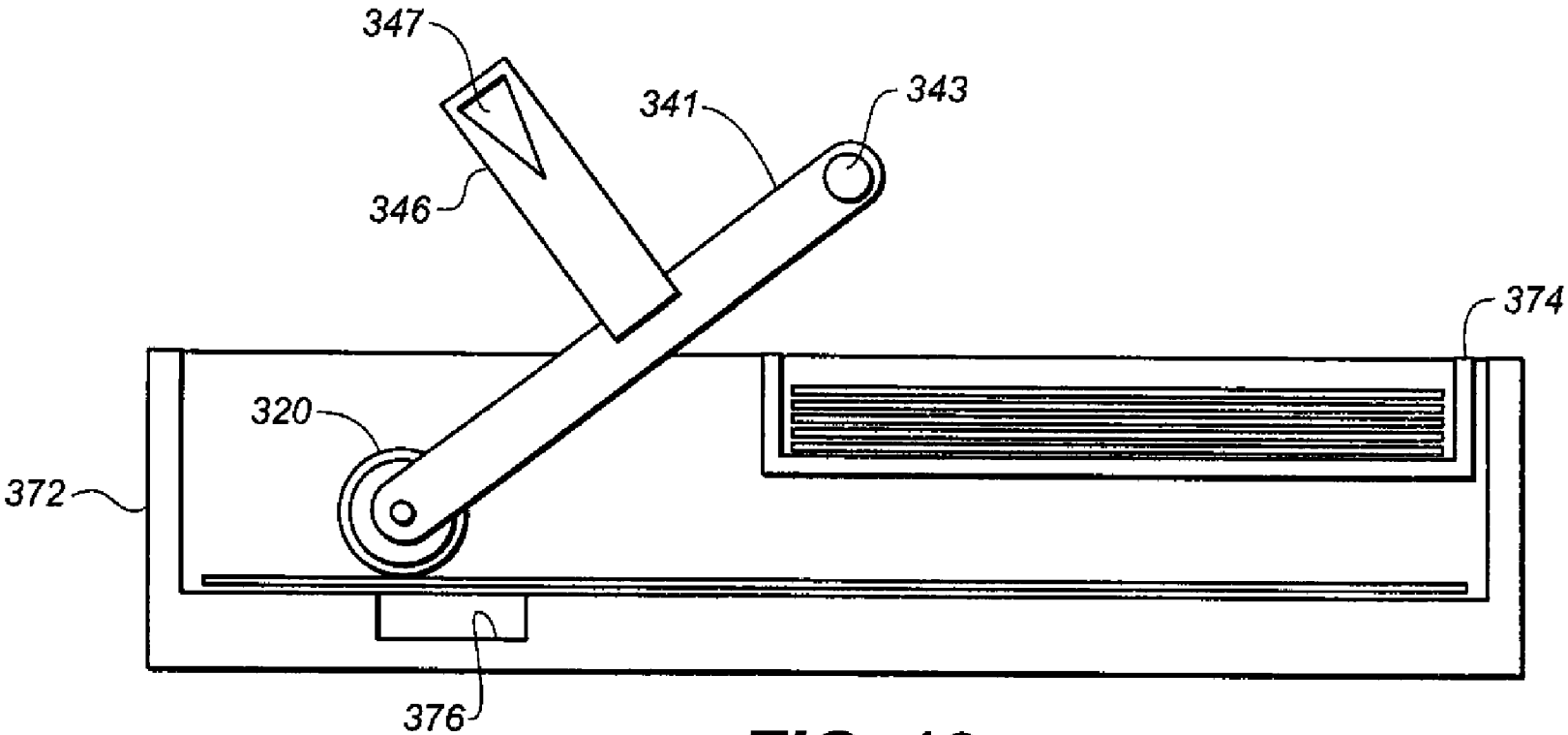
FIG. 12 is a schematic side view of the pick arm and optical block in an embodiment where the tray has a recess.
Figure 13:
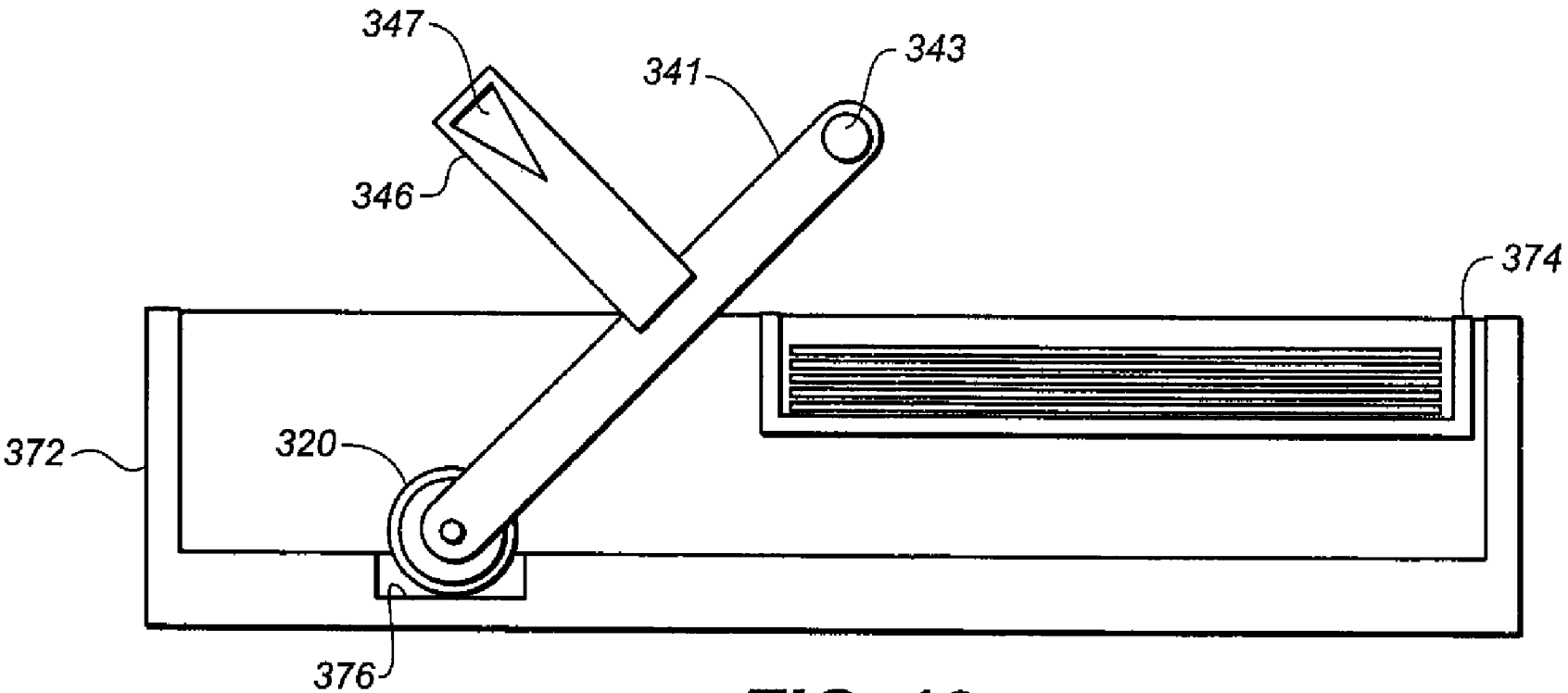
FIG. 13 is a schematic side view of the embodiment of FIG. 13 where the tray is out of paper and the pick roller is in the recess.

Although it can be particularly important for the printer to be aware when it is completely out of paper in a paper tray (and optionally let the user know of that), in some embodiments, the sensing method described above is not sufficiently sensitive to distinguish between a single sheet of paper remaining and no paper remaining. FIGS. 12 and 13 show an embodiment where main paper tray 372 has a recess 376 in the pivoting path of the pick roller 320. In FIG. 12, there is a single sheet of paper remaining and the single sheet holds pick roller 320 from moving into recess 376. In FIG. 13, the main tray 372 is empty and the pick roller moves a relatively large distance (compared to the thickness of a single sheet of paper) into recess 376. The resulting large change in signal as the corresponding window of the optical block lets a different amount of light pass from light emitter 353 to optical sensor 351 is interpreted by the controller as the tray being out of paper. Although this example shows a recess 376 in the main paper tray 372, a recess may also be provided in the photo media tray 374.

In embodiments described above, the optical block and its window are an example of a member having a measurable property that is sensed by a sensor (in this example a varying extent to which light from a neighboring optical source is blocked from being received by a photosensor), in correlation with a position of an individual sheet of media in a media holder, where the member or the sensor is movable along a path such that the measurable property is sensed by the sensor in order to provide a signal that is indicative of the position of the individual sheet of media in a media holder. The member is attached to the pick arm and the pick roller is the element that is positioned to contact the individual sheet of media. In such embodiments, because the member is not touching a sheet of media, it does not provide drag on the sheet of media as the pick roller moves the media. More generally, a member may have other types of measurable properties such as a variable capacitance, a variable resistance, a variable magnetic field strength, a variable spring force, a variable optical reflectance, etc., which may be sensed by an appropriate sensor to indicate the position of an individual sheet of media.

Figure 14:
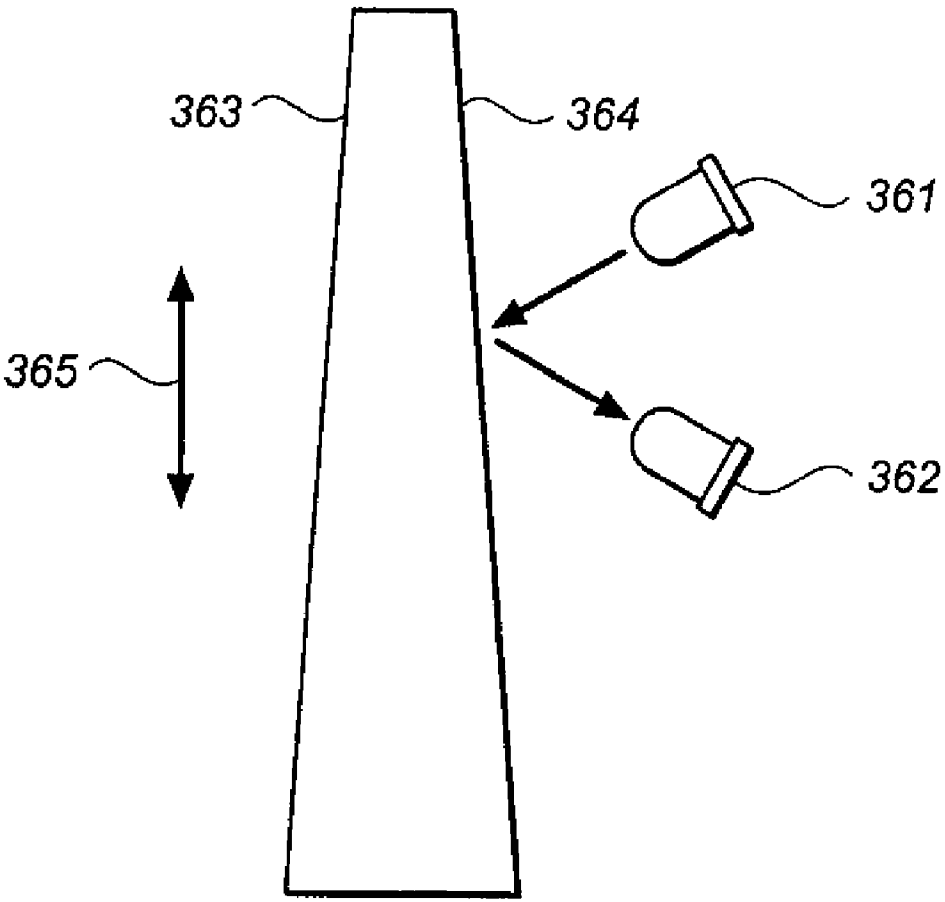
FIG. 14 is a schematic side view of an embodiment using the amount of reflected light received by an optical sensor.

FIG. 14 shows a side view of an optically reflective member 363 having a side 364 that reflects varying amounts of light from light emitter 361 to optical sensor 362 (from which light emitter 361 is spaced apart), where the varying amount of light depends upon the position of optically reflective member 363 relative to the light emitter 361 and optical sensor 362 along movement direction 365. Therefore if optically reflective member 363 is movable by pick arm assembly 340 so that side 364 is in the optical path between light emitter 361 and optical sensor 362, a signal indicative of the position of optically reflective member 363 (and the corresponding position of an individual sheet of media in contact with pick roller 320) is provided by optical sensor 362. In the example of FIG. 14 the reason why the amount of light received by optical sensor 362 varies as optically reflective member 362 is moved along movement direction 365 is that side 364 is angled. An alternative not shown would be to have the optical reflectance of side 364 be varying along direction 365. For example, the optical reflectance of side 364 can be varied by providing a gradient in the surface finish from smooth and very reflective to rough and less reflective.

Figure 4:
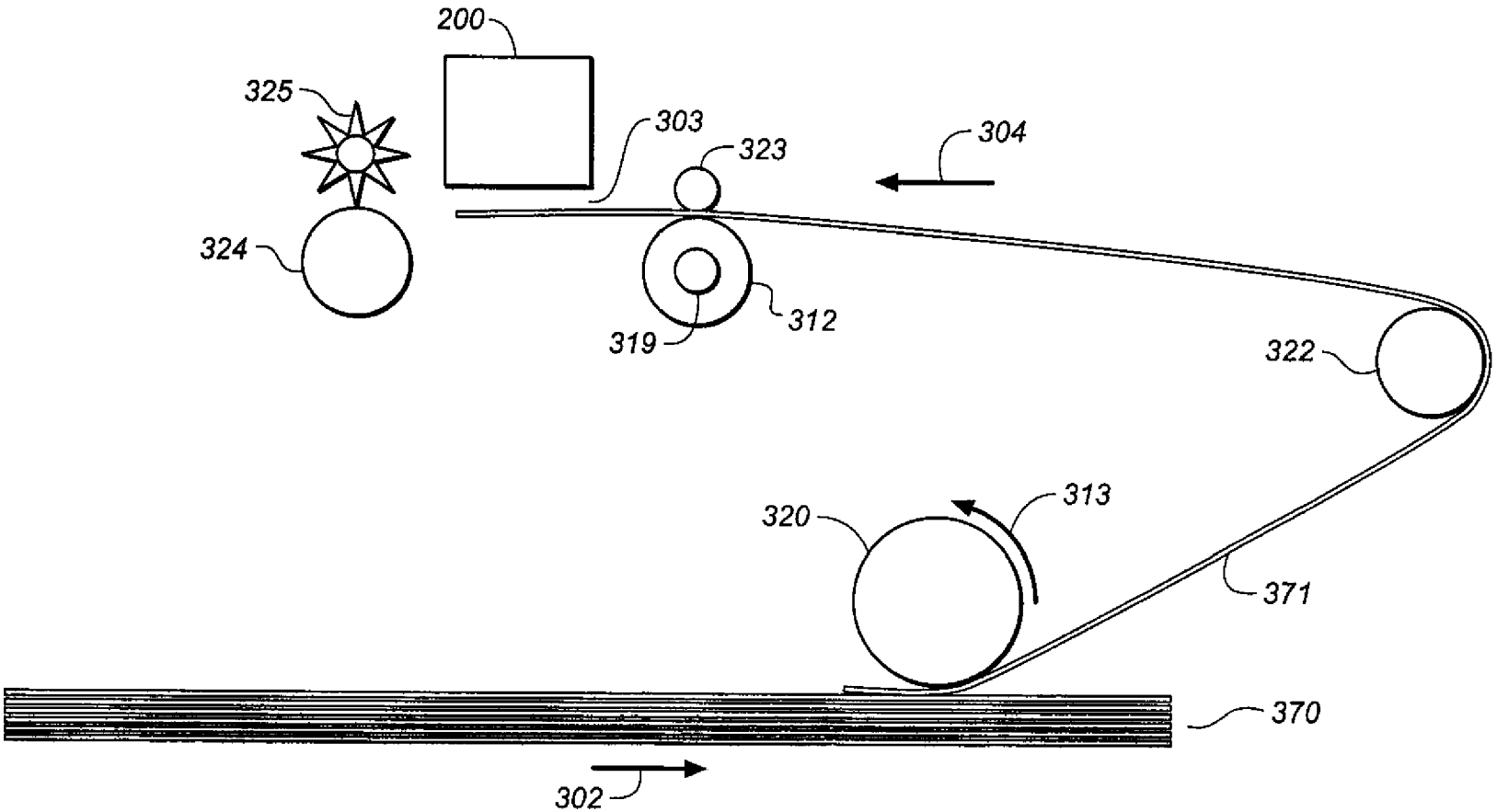
FIG. 4 is a schematic side view of a paper path in a carriage printer.

Also more generally, the media holder need not be a tray, and the media holder need not be horizontal as illustrated in FIGS. 4 through 6. Herein, media holder and tray are used interchangeably. In other paper path configurations not shown here, the media holder can be oriented in a more vertical fashion, so that the individual sheet of media which is contacted by the pick roller is not a "top" sheet. Furthermore, the media stack need not be an input source of recording media, but it can be a stack of documents to be scanned, for example.

If the thickness of media is known, the height of the stack of media can be converted to a number of remaining sheets in the media holder by dividing the stack height by the media thickness. Information about the thickness of the media may be provided by the user (e.g. by supplying information about a media type) or may be included in the information about a media type which is provided by a media type detector when reading a code of manufacturer's markings that have been marked on the media.

Figure 15:
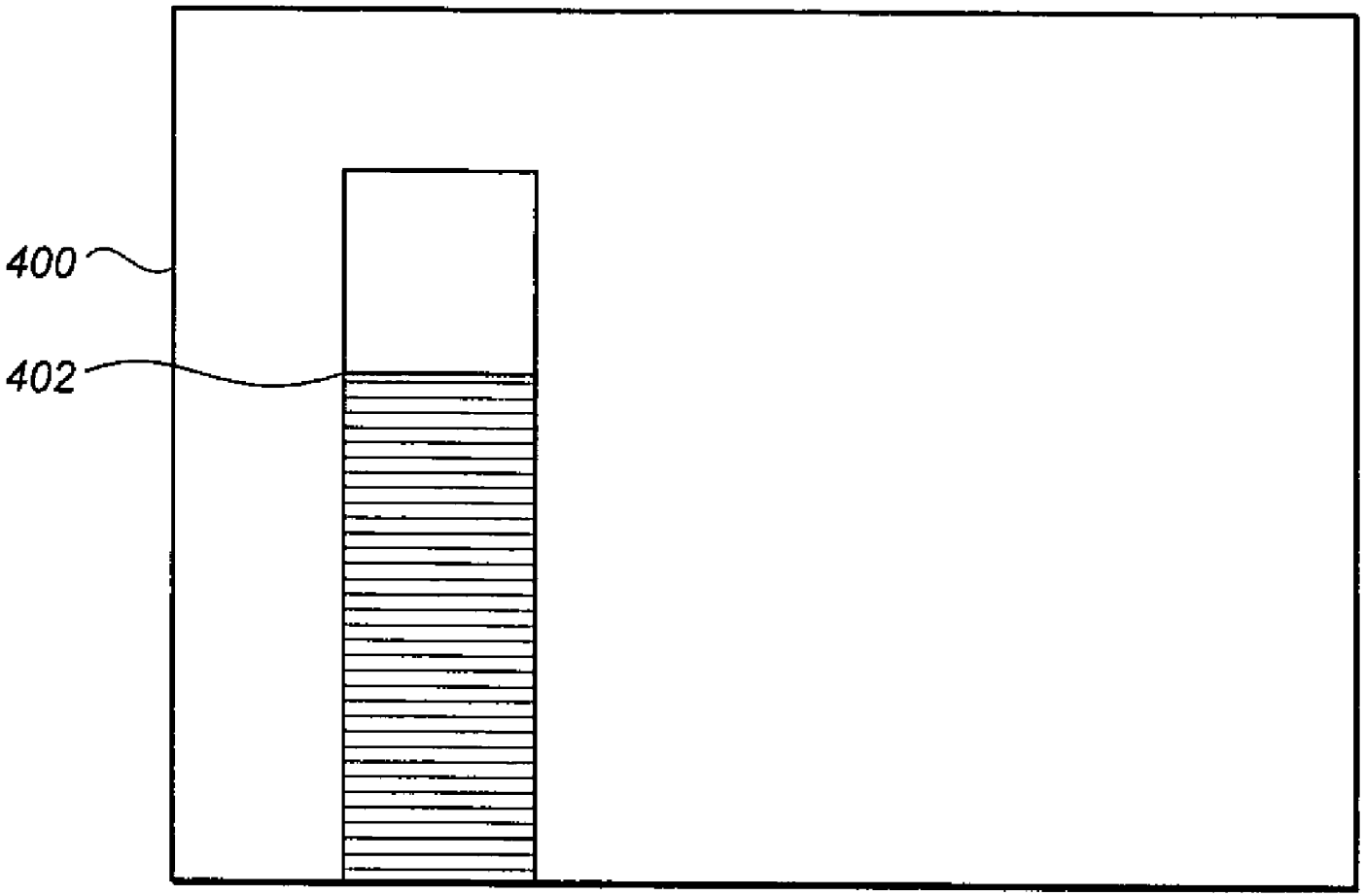
FIG. 15 is a schematic representation of a display that graphically shows the relative amount of media in a tray.

The stack height (or number of sheets) may be communicated to the user by a display or monitor which is attached to the printing system or to an associated host computer, for example. FIG. 15 shows an example of a display 400 which graphically shows an amount of media 402 that is present in a paper tray. Optionally, in the same display, the amount of remaining ink may also be shown, so that in one glance the user can know both how much ink of different colors and how much media he has left.

Alternatively, an audible signal can be sent to a speaker in a printing system or an associated host computer to indicate position of an individual sheet of media in the media holder. For example, when the media holder is completely empty, an audible alarm will sound.

The invention has been described in detail with particular reference to certain preferred embodiments thereof, but it will be understood that variations and modifications can be effected within the spirit and scope of the invention.

PARTS LIST

10 Inkjet Printer System
12 Image Data Source
14 Controller
15 Image Processing Unit
16 Electrical Pulse Source
18 First Fluid Source
19 Second Fluid Source
20 Recording Medium
100 Ink Jet Printhead
110 Ink Jet Printhead Die
111 Substrate
120 First Nozzle Array
121 Nozzle in First Nozzle Array
122 Ink Delivery Pathway for First Nozzle Array
130 Second Nozzle Array
131 Nozzle in Second Nozzle Array
132 Ink Delivery Pathway for Second Nozzle Array
181 Droplet Ejected From First Nozzle Array
182 Droplet Ejected From Second Nozzle Array
200 Carriage
250 Printhead Chassis
251 Printhead Die
253 Nozzle Array
254 Nozzle Array Direction
256 Encapsulant
257 Flex Circuit
258 Connector Board
262 Multichamber Ink Supply
264 Single Chamber Ink Supply
300 Printer Chassis
302 Paper Load Entry
303 Print Region
304 Paper Exit
306 Right Side of Printer Chassis
307 Left Side of Printer Chassis
308 Front Portion of Printer Chassis
309 Rear Portion of Printer Chassis
310 Hole for Paper Advance Motor Drive Gear
311 Feed Roller Gear
312 Feed Roller
313 Forward Rotation of Feed Roller
319 Feed Roller Shaft
320 Pickup Roller
322 Turn Roller
323 Idler Roller
324 Discharge Roller
325 Star Wheel
330 Maintenance Station
340 Pick Arm Assembly
341 Pick Arm Frame
342 Drive Gear
343 Axle
344 Torsion Spring
345 Gear Train
346 Optical Block
347 Window
349 Bracket
351 Optical Sensor
352 Sensor Housing
353 Optical Source
354 Aperture
356 Optical Block
357 Window
359 Direction of Motion
361 Light Emitter
362 Optical Sensor
363 Optically Reflective Member
364 Varying Portion of Optically Reflective Member
365 Movement Direction
370 Stack of Media
371 Top Sheet
372 Main Paper Tray
373 Photo Paper Stack
374 Photo Paper Tray
376 Recess in Paper Tray
380 Carriage Motor
382 Carriage Rail
384 Belt
390 Printer Electronics Board
392 Cable Connectors
400 Display
402 Displayed Amount of Media in a Tray

What is claimed is:

1. A printing system comprising:

a tray configured to hold a plurality of sheets of recording media;

a pick arm including a pick roller, the pick roller configured to contact an individual sheet of the plurality of sheets of media in the tray;

a light emitter;

an optical sensor spaced apart from the light emitter; and a member that is movable by the pick arm in order to provide a signal indicative of a position of the individual sheet of the plurality of sheets of media in the tray, wherein the member includes a length, wherein a varying degree of light-blocking capability of the member is provided by an open area within an opaque body, and wherein the open area includes a varying width disposed along a length of the member.

2. The printing system of claim 1, wherein the position of the individual sheet of media in the tray may be converted to a quantity of sheets of media remaining in the tray.

3. The printing system of claim 1, wherein the signal indicative of the position of the individual sheet of media in the tray may be graphically displayed on a monitor in order to indicate the amount of media remaining in the tray.

4. The printing system of claim 1, wherein the width of the open area varies nonlinearly along the length of the member.

5. The printing system of claim 1, further including:

an optical path between the light emitter and the optical sensor; and at least one aperture disposed within the optical path between the light emitter and the optical sensor.

6. The printing system of claim 1, wherein the open area of the member is operationally coupled to an aperture in a housing for the sensor, the aperture has a first dimension that is substantially along a first direction; and a second dimension that is along a second direction, the second direction being substantially perpendicular to the first direction, wherein the first dimension is less than the second dimension.

7. The printing system of claim 6, wherein the first dimension of the aperture is between 0.1 mm and 3.0 mm.

8. The printing system of claim 1, the pick arm being pivotable, wherein the media holder includes a recess for receiving the pick roller.

* * * * *